United States Patent [19]

Mankins et al.

[11] Patent Number: 4,816,218

[45] Date of Patent: Mar. 28, 1989

[54] PROCESS OF USING AN IRON-NICKEL-CHROMIUM ALLOY IN AN OXIDATION ATTACKING ENVIRONMENT

[75] Inventors: William L. Mankins; Jerry A. Harris; James C. Hosier, all of Huntington, W. Va.; Raymond J. Kenny, Chappaqua, N.Y.

[73] Assignee: Inco Alloys International, Inc., Huntington, W. Va.

[21] Appl. No.: 67,292

[22] Filed: Jun. 29, 1987

Related U.S. Application Data

[63] Continuation of Ser. No. 667,011, Nov. 1, 1984, abandoned.

[51] Int. Cl.[4] ..... C22C 30/00

[52] U.S. Cl. ..... 420/584; 420/54

[58] Field of Search ..... 420/584, 54, 55; 148/442

[56] References Cited

FOREIGN PATENT DOCUMENTS 1190047 4/1970 United Kingdom ..... 420/584

*Primary Examiner*—Deborah Yee

*Attorney, Agent, or Firm*—Raymond J. Kenny; Francis J. Mulligan, Jr.

[57] ABSTRACT

The oxidation resistance at elevated temperatures, e.g. 1800° F. of iron-nickel-chromium alloys of specified composition is improved through the control of manganese content.

1 Claim, No Drawings

PROCESS OF USING AN IRON-NICKEL-CHROMIUM ALLOY IN AN OXIDATION ATTACKING ENVIRONMENT

This is a continuation of application Ser. No. 667,011 filed on Nov. 1, 1984, now abandoned.

FIELD OF INVENTION

The present invention is directed to improving the oxidation resistance of a well established commercial iron-nickel-chromium alloy.

BACKGROUND OF INVENTION

For many years an iron-nickel-chromium alloy nominally containing 30–35% Ni, 19–23% Cr, 0.15 to 0.6% aluminum, 0.15 to 0.6% titanium, up to 0.75% copper, up to 1% silicon, about 0.1% carbon, iron balance plus impurities, has been used in such applications as heat exchanger tubing, process piping, carburizing fixtures and retorts, furnace components, heating element sheathing, etc. It is known for its resistance to oxidation at elevated temperatures and for a number of other properties, including stable structure, ductility, resistance to carburization, corrosion resistance, etc.

SUMMARY OF INVENTION

Notwithstanding the attributes of the above-described commercial alloy, it has been found that its resistance to oxidation at elevated temperatures can be improved through controlling the percentage of manganese present in the composition.

INVENTION EMBODIMENTS

Generally speaking, the present invention contemplates improving the oxidation resistance in otherwise manganese-containing iron-nickel-chromium alloys by controlling the manganese level such that it does not exceed about 0.6%. Manganese, as is known, confers a number of advantages by reason of its presence in such materials, including its ability to fix sulfur which otherwise exercises a detrimental influence in respect of various metallurgical characteristics. Also, manganese is deemed to enhance weldability and is considered to act as a deoxidant. Its use is thought to be a carryover from steelmaking practice. In any case, it is not the principal aim of the invention to eliminate manganese as an essential constituent from the type of iron-nickel-chromium alloys under consideration but rather the objective is to control it to obtain the benefits of improved oxidation resistance as demonstrated herein.

In Table I below are given the compositions of the Commercial Alloy and an alloy, Alloy 1, representative of the instant invention:

TABLE I

| Alloy | Mn % | C % | Ni % | Cr % | Al % | Ti % | Cu % | Si % | Fe % |
|---|---|---|---|---|---|---|---|---|---|
| Commercial | 0.96 | 0.04 | 31.13 | 21.43 | 0.52 | 0.47 | 0.45 | 0.36 | Bal. |
| 1 | 0.10 | 0.05 | 32.93 | 20.93 | 0.45 | 0.50 | 0.04 | 0.54 | Bal. |

Bal. = balance plus impurities

Table II is a report of oxidation behavior after test. In this connection air-melted 14 kg samples were forged to flats, hot rolled to 0.312 inch and cold rolled to 0.125 inch. A cyclic oxidation test was utilized and this consisted of holding the specimen for 15 minutes at temperature (1800° F.), and then cooling 5 minutes in air. This cycle was repeated over a test period of 1000 hours. Specimens were examined after 100 hour increments. Prior to test the specimens were annealed at 2150° F. and water quenched. Oxide was removed by grinding to 120 grit.

TABLE II

CYCLIC OXIDATION DATA

| Alloy | Weight Change/Unit Area, mg/cm$^2$ 100 hr | 200 hr | 300 hr | 400 hr | 500 hr | 700 hr | 1000 hr | Depth of Attack (in.) |
|---|---|---|---|---|---|---|---|---|
| Commercial | +1.7 | +1.5 | −1.5 | −24.8 | −41.4 | −69.6 | −115.9 | 0.008 |
| 1 | +1.2 | −1.6 | +2.1 | +2.3 | +2.5 | +3.7 | +1.5 | 0.005 |

As can be seen from Table II, Alloy 1 of the invention performed considerably better than the Commercial Alloy, the difference being largely in the manganese content 1% vs. 0.1%, respectively.

Upon cyclic oxidation testing at 2000° F. similar pattern can be observed from Tables III and IV.

TABLE III

| Alloy | Mn % | C % | Ni % | Cr % | Al % | Ti % | Cu % | Si % | Fe % |
|---|---|---|---|---|---|---|---|---|---|
| Commercial | 1.00 | 0.05 | 32.77 | 20.24 | 0.42 | 0.45 | 0.35 | 0.36 | Bal. |
| 2 (Invention) | 0.14 | 0.06 | 31.84 | 21.01 | 0.30 | 0.38 | 0.01 | 0.23 | Bal. |

TABLE IV

CYCLIC OXIDATION TEST AT 2000° F.

| Alloy | Weight Change/Unit Area, mg/cm$^2$ 100 hr | 200 hr | 300 hr | 400 hr | 500 hr | 700 hr | 1000 hr | Depth of Attack, in. |
|---|---|---|---|---|---|---|---|---|
| Commercial | +2.6 | −40.1 | −86.1 | −124.4 | −156.8 | −223.1 | −316.4 | 0.020 |
| 2 | +1.5 | +1.7 | −1.4 | −25.2 | −42.7 | −78.2 | −135.3 | 0.009 |

It is deemed that the subject invention is applicable to iron-nickel-chromium alloys which experience or would experience a loss in oxidation resistance by reason of manganese being a constituent to the excess. In this connection, the invention is particularly directed to alloys containing 20 to 45% nickel, 15 to 25% chromium, manganese in an amount up to about 0.6%, up to 0.3% carbon, up to 1% aluminum, up to 1% titanium, up to 2% copper, balance essentially iron. Silicon, if present, need not exceed 1.5%. Sulfur and phosphorus should be maintained at low levels consistent with good melt practice. Nitrogen can be present up to about 0.3%, e.g., 0.05 to 0.25%. It is preferred that at least one, advantageously both, of aluminum and titanium be present in amounts from 0.05 to 0.75%.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention in which an exclusive property or privilege is claimed are defined as follows:

1. A new use for a nickel-chromium-alloy consisting of 30 to 35% nickel, about 19 to 23% chromium, from 0.15 to 0.6% each of aluminum and titanium, up to about 2% copper, silicon present to 1% carbon present to 0.1%, manganese present in a controlled amount to 0.6%, the balance being iron, which comprises the process of exposing the alloy to oxidation attack in an oxidation attacking environment at an elevated temperature up to as high as 1800° F. to 2000° F., the oxidation resistance of the alloy being enhanced by reason of the controlled manganese content.

* * * * *